US006912784B2

(12) United States Patent
Behner et al.

(10) Patent No.: US 6,912,784 B2
(45) Date of Patent: Jul. 5, 2005

(54) DEVICE AND METHOD FOR PRODUCING A CATALYST WITH A MONOLITH HAVING A POLYGONAL CROSS-SECTION

(75) Inventors: Attila Behner, Schauenburg (DE); Fred Emde, Kassel (DE); Rudi Reintanz, Guxhagen (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 10/257,693

(22) PCT Filed: Apr. 10, 2001

(86) PCT No.: PCT/EP01/04064

§ 371 (c)(1),
(2), (4) Date: Feb. 21, 2003

(87) PCT Pub. No.: WO01/79668

PCT Pub. Date: Oct. 25, 2001

(65) Prior Publication Data

US 2003/0159286 A1 Aug. 28, 2003

(30) Foreign Application Priority Data

Apr. 15, 2000 (DE) ..... 100 18 805

(51) Int. Cl.[7] ..... B21D 51/16; B21D 31/00; B01D 50/00

(52) U.S. Cl. ..... 29/890; 29/508; 29/516; 29/517; 422/168; 422/177; 422/180; 72/292

(58) Field of Search ..... 29/890, 508, 516, 29/517; 422/179, 168, 177, 180; 72/402, 465.1, 292

(56) References Cited

U.S. PATENT DOCUMENTS

| | | | | | |
|---|---|---|---|---|---|
| 51,636 | A | * | 12/1865 | Weitman | 72/292 |
| 1,284,375 | A | * | 11/1918 | Lee | 72/125 |
| 2,483,659 | A | * | 10/1949 | Miller | 72/292 |
| 4,070,894 | A | * | 1/1978 | Smith | 72/292 |
| 2001/0055551 | A1 | | 12/2001 | Schnigenberg | |

FOREIGN PATENT DOCUMENTS

| | | |
|---|---|---|
| DE | 39 29 205 | 3/1991 |
| DE | 198 03 063 | 7/1999 |
| DE | 198 38 750 | 3/2000 |
| EP | 837 299 | 4/1998 |

* cited by examiner

*Primary Examiner*—Marc Jimenez
(74) *Attorney, Agent, or Firm*—Ostrolenk, Faber, Gerb & Soffen, LLP

(57) ABSTRACT

A process for producing a catalyst by providing a monolith with a polygonal cross section, tightly enclosing the monolith with a single part jacket made of metal sheet or plate, placing a layer of expanded matting between the jacket and the monolith, bending the jacket with at least one of a bending and a clamping device into a proper final shape so that edges of the jacket which extend at least essentially in a longitudinal direction of the monolith at least contact each other, and undetachably joining the edges to each other.

15 Claims, 2 Drawing Sheets

DEVICE AND METHOD FOR PRODUCING A CATALYST WITH A MONOLITH HAVING A POLYGONAL CROSS-SECTION

PRIORITY CLAIM

This is a U.S. national stage of application No. PCT/EP01/04064, filed on 10 Apr. 2001. Priority is claimed on that application and on the following application: Country: Germany, Application No.: 100 18 805.2, Filed: 15 Apr. 2000.

BACKGROUND OF THE INVENTION

The invention pertains to a process and to a device for the production of a catalyst comprising a monolith with a polygonal cross section. A polygon in the present context is understood to mean a shape with multiple sides, the corners of which are rounded.

Exhaust gas catalysts for motor vehicles consist of a central, rod-shaped, ceramic honeycomb, called a "monolith", through which many fine channels pass in the longitudinal direction. The monolith is surrounded by a jacket of metal sheet or plate, especially of special steel, between which and the monolith a layer of so-called expanded matting of mineral fiber is placed. The jacket made of metal sheet or plate must be seated very tightly around its entire circumference to ensure that the impact-sensitive material of the monolith is not damaged, especially during the operation of the motor vehicle; so that no annoying rattling noises occur; and so that the seal between the monolith and the jacket made of metal sheet or plate is preserved. It must also be taken into account that the jacket made of metal sheet or plate is cold when not in operation but very hot during operation. As a result, the jacket made of metal sheet or plate is subject to a certain amount of expansion and shrinkage around the circumference.

These types of catalysts, obviously for cost reasons, have been produced so far only with circular cross sections, for it is generally known that circular cross sections are the easiest to seal. Stricter legal regulations and the demand for better utilization of the space available in the motor vehicle, however, have made it appear desirable today to produce catalysts which deviate from the circular form and which in particular have a polygonal shape as defined above. But even when a shape such as this is used, the jacket made of metal sheet or plate must still wrap so tightly around the monolith that the expanded matting will still provide a sufficiently strong, leak-proof seat and simultaneously offer a certain amount of damping.

SUMMARY OF THE INVENTION

The invention is based on the task of providing a process in which the technical requirements cited above can also be satisfied by a catalyst which has the cross-sectional form of a rounded polygon. Another of its tasks is to propose a device for implementing this process.

The invention accomplishes these tasks in the case of a catalyst of the general type in question here in that the jacket made of metal sheet or plate consists of a single piece of metal sheet or plate. The jacket made of metal sheet or plate is bent by a bending and/or clamping device into its proper final shape in such a way that the edges of the jacket extending at least essentially in the longitudinal direction of the monolith overlap or at least contact each other. The edges are then joined undetachably to each other.

The invention makes it possible to design a catalyst with a cross section which deviates considerably from the ideal circular shape. Polygons with corners which are rounded with large radii are especially suitable, because in such form the monoliths themselves are also easy to produce. Only a longitudinal seam remains to be produced to complete the jacket made of metal sheet or plate, which can be produced very economically from plates cut from coil stock. If the edges to be joined are intended to overlap, relatively wide tolerances in the dimensions of the monolith or of the plates can be compensated in the area of the overlap without any additional effort. The overlapping edges of the jacket made of metal sheet or plate can then be welded under an inert gas, for example, with a greater or lesser degree of overlap. If, however, the edges rest perfectly flush against each other to form a butt joint, additional welding material can be applied to the joint to produce the connection.

As a rule, the jacket made of metal sheet or plate will be brought into a shape at least closely approximating its final form before its edges are set up for joining and joined. This preshaping of the jacket made of metal sheet or plate can be accomplished in a separate bending device upstream. Then the preshaped jacket made of metal sheet or plate is clamped in a clamping device together with the expanded matting and the polygonal monolith in such a way that the jacket made of metal sheet or plate now fully assumes its proper final shape and the edges are located in positions where they can be joined to each other, whereupon the edges are then finally joined.

During the preshaping step, the jacket made of metal sheet or plate is pre-bent in the bending device into a polygonal form which is at least almost completely closed in the circumferential direction.

A device for implementing the process according to the invention provides that a clamping device surrounds the jacket made of metal sheet or plate and comprises at least two shaped pieces on the circumference of the jacket. These pieces are connected to each other by at least one flexible tension element and can be moved toward each other by a force-actuated device in such a way that the circumference of the clamping device and thus of the jacket made of metal sheet or plate is reduced but also so that access to the edges to be joined nevertheless remains between the shaped pieces.

With a clamping device of this type, a high degree of processing reliability is achieved in the production of the final shape of the jacket made of metal sheet or plate and thus in the provision of a permanent, secure seat for the jacket on the monolith, because the radial clamping forces are proportional to the tensile force applied by the tension element.

If a certain circumferential area is to be subjected to greater force in the radial direction, a pressure pad can be provided at that point, which is pressed by the flexible tension element against the jacket made of metal sheet or plate. As an alternative, the flexible tension element itself can already include the pressure pad which acts on the jacket made of metal sheet or plate at the circumferential area in question.

The flexible tension element can be designed in any suitable way. At least certain sections of it can be in the form of cables, chains, etc. If it is designed as a chain made up of balls, rollers, or rings, then the pressure pad can take the form of what amounts to a reinforced link in the chain, that is, a larger ball or a larger roller. Otherwise, the flexible tension element can be guided by appropriately designed means either over or through the pressure pad, which can have any suitable form, in which case the tension element retains its original shape. If the pressure pads curve outward on one side toward the jacket made of metal sheet or plate, the uniform application of radial tension on the jacket by the tension element can produce a shape which is basically polygonal but which also has at least certain slightly concave areas.

The force-actuated device acting on the tension element can comprise tie rods, upon which, for example, force is exerted in a direction approximately tangential to the jacket made of metal sheet or plate, adjacent rods being actuated in opposite directions. The device could also comprise force-actuated knuckle joints.

The force-actuated device can be actuated and controlled either mechanically, pneumatically, or hydraulically.

The bending and/or clamping device can have at least one base for the tension element and/or for a pressure pad on the side opposite the edges and thus opposite the weld. The shape of the base can thus be designed to conform to the shape of the tension element and/or to that of the pressure pad.

The profiled pieces and/or the pressure pads can be designed to conform to the cross section of the final shape of the jacket made of metal sheet or plate.

The device according to the invention ensures that defined retaining forces will hold the monolith and the jacket made of metal sheet or plate together for a wide variety of polygonal, rounded cross sections. It thus opens the way to the reliable fabrication of catalysts with cross sections which deviate considerably from the circular and which, in the extreme case, can even have slightly concave areas at certain points on the circumference. Thus a high degree of flexibility is obtained in terms of adapting the shape of the catalyst to fit the available space. Because of the high degree of flexibility in designing the cross section, maximum and thus optimal use can be made of the available space, which is especially advantageous in the field of automotive manufacturing.

BRIEF DESCRIPTION OF THE DRAWINGS

The invention is explained in the drawing in the form of an exemplary embodiment. For this purpose, the process is illustrated schematically and described in greater detail in conjunction with the associated device.

DETAILED DESCRIPTION OF THE PREFERRED EMBODIMENTS

Figure 1:
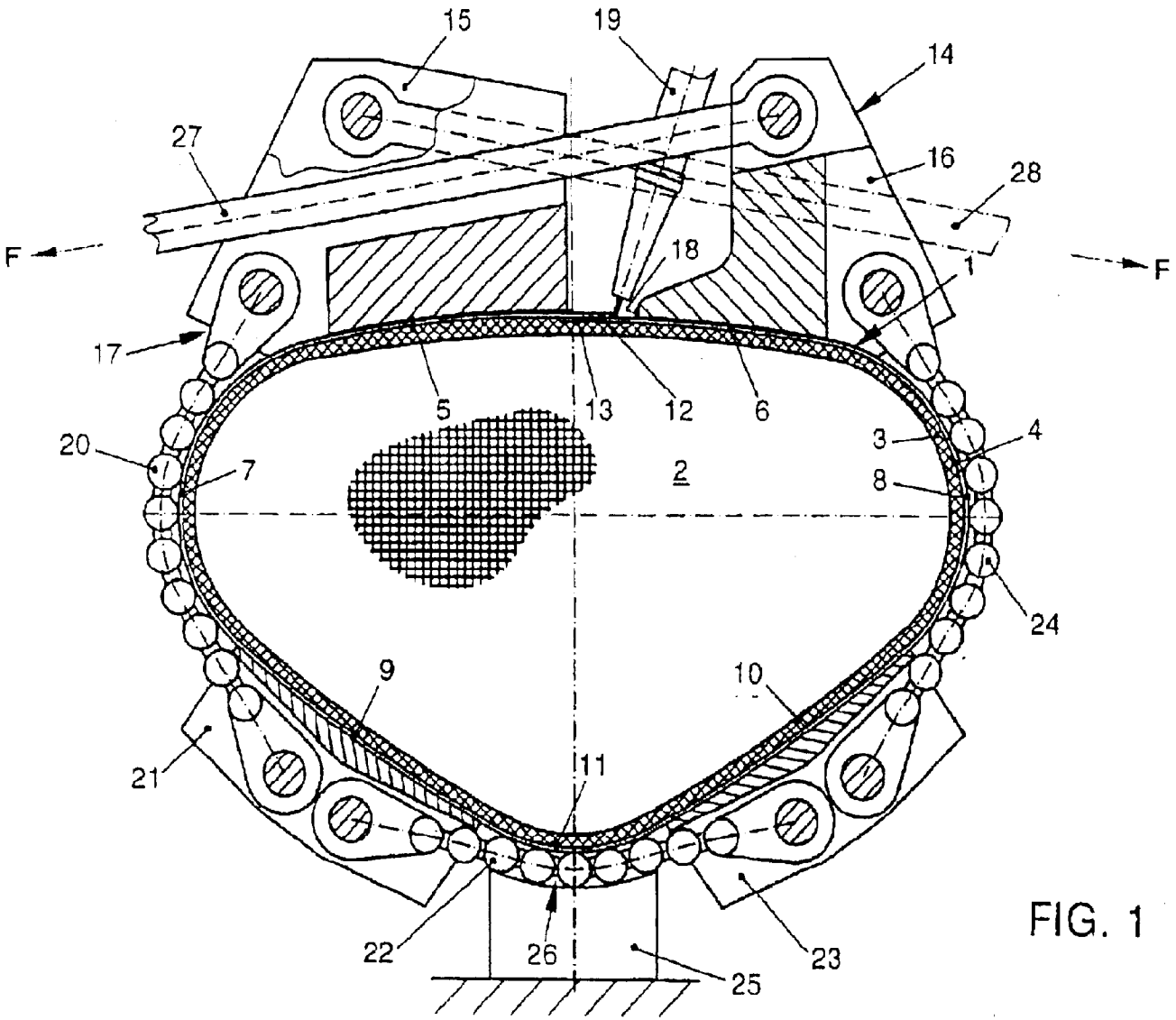
FIG. 1 shows a side view of a premounted catalyst with an approximately tri-oval cross section surrounded by a preshaped jacket made of metal sheet or plate, which is clamped in a clamping device and prepared for welding.

The catalyst 1 in FIG. 1 consists first of the central, rod-shaped ceramic honeycomb with a tri-oval cross section, called the monolith 2. The monolith 2 is surrounded under pretension by a layer of so-called expanded matting 3 of mineral fiber and by a jacket made of metal sheet or plate 4. The jacket made of metal sheet or plate consists of a chromium-nickel steel, plates of which have been cut from coil stock and then preshaped in a bending device (not shown) to obtain a nearly closed form.

The preshaped jacket made of metal sheet or plate 4 is bilaterally symmetric in cross section and comprises arc-shaped sections 5–11, which are curved to different degrees. The jacket made of metal sheet or plate 4 also comprises two overlapping edges areas 12, 13, which extend in the longitudinal direction of the monolith 2 and which are to be joined undetachably to each other.

The monolith 2, the expanded matting 3, and the jacket made of metal sheet or plate 4 are laid in a clamping device 14. The clamping device 14 comprises two profiled pieces 15, 16, which are connected to each other by a flexible tension element, designed as a roller chain 17. The profiled pieces 15, 16 and the roller chain 17 wrap around the jacket made of metal sheet or plate 4 almost completely, leaving only a gap 18 between the profile pieces 15, 16. In this gap 18, the edge areas 12 and 13 lie on top of each other, so that a welding torch 19 can be used to produce a weld under an inert gas.

The profiled piece 15 covers and compresses the section 5 of the jacket made of metal sheet or plate 4. The roller chain 17 is hinged to the profiled piece 15; the chain consists of a first chain section 20, which presses on the section 7. The chain section 20 is hinged to a pressure pad 21, which presses on the section 9. A second chain section 22 is hinged to the pressure pad 21, and this section of chain presses on section 11. A second pressure pad 23, which is hinged to the chain section 22, presses on the section 10. A third chain section 24 is hinged to the second pressure pad 23 and presses on the section 8. The third chain section 24, finally, is hinged to the profile piece 16, which presses on the section 6.

It is obvious that the jacket made of metal sheet or plate 4 is subjected to radial force over the entire set of sections 5–11 forming its circumference and is thus pressed together with the expanded matting 3 against the monolith 2.

The pressure is applied uniformly, because the flexible chain sections 20, 22, and 24 fit snugly around the relatively highly curved sections 7, 11, and 8 of the jacket made of metal sheet or plate 4, whereas the profiled pieces 15 and 16 conform to the flatter sections 5 and 6, and the pressure pads 21 and 23 conform to the curvature of the also relatively flat sections 9 and 10, that is, to the desired final shape of these sections.

To support the assembly and the clamping device 14, a base 25 is provided, on which the chain section 22 can be supported. The base 25 with its support surface 26 is designed to conform to the curvature of the chain section 22 and thus indirectly to the curvature of the section 11.

Figure 2:
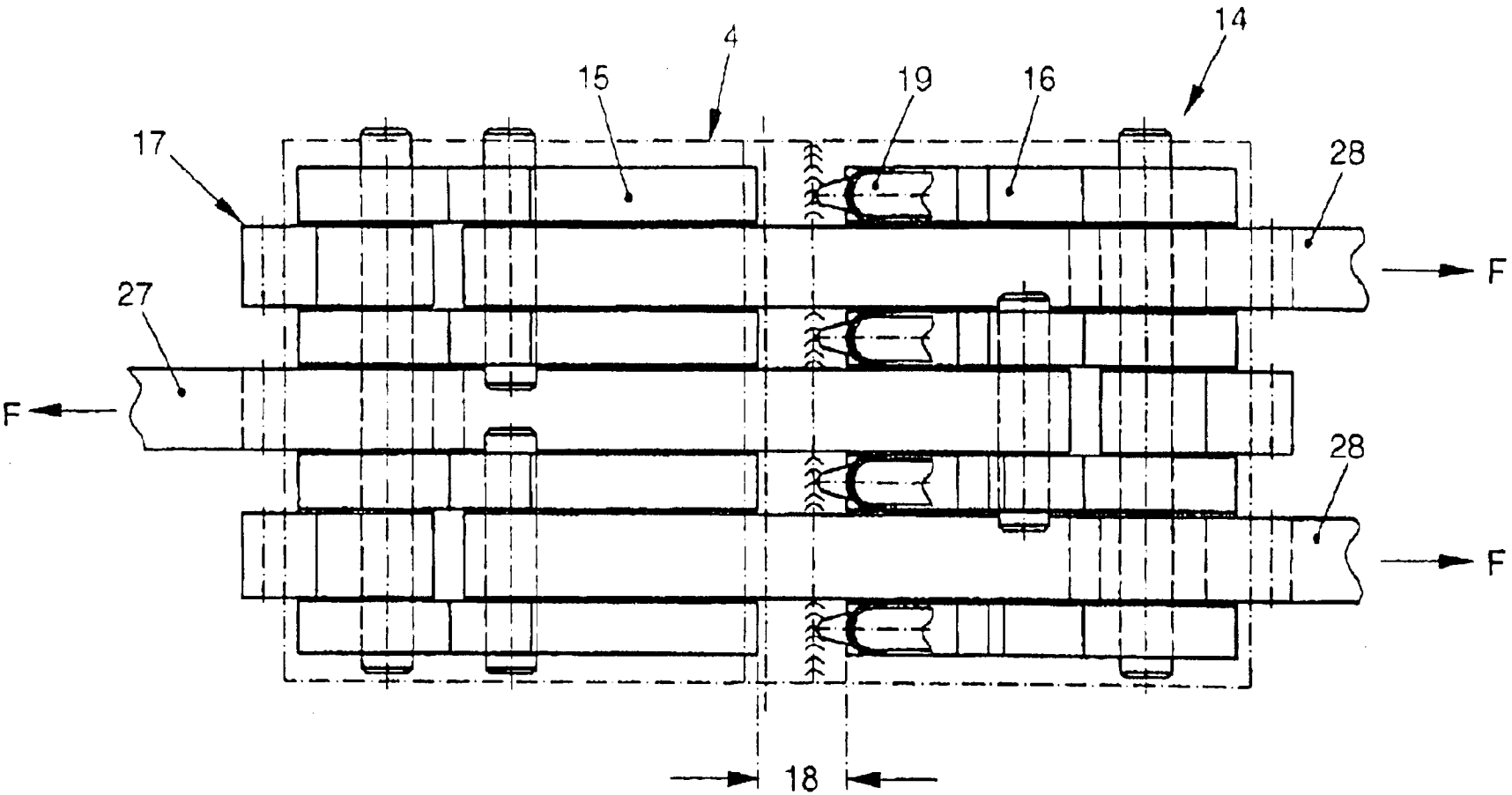
FIG. 2 shows a top view of the clamping device according to FIG. 1.

The clamping device 14 also includes a force-actuated device in the form of tie rods 27, 28. The tie rods 27, 28 are hinged alternatively to the profiled pieces 15, 16 (see also FIG. 2). Forces F act on them in a direction approximately tangential to the jacket made of metal sheet or plate 4. These forces F hold all the participating components securely in position until the edges 12 and 13 have been welded together.

The tie rods 27 and 28 can also be actuated by knuckle joints. The necessary forces can be generated mechanically, pneumatically, or hydraulically.

The invention has been described by way of example on the basis of a so-called tri-oval cross section. The process according to the invention, however, can also be used for a wide variety of other types of rounded, polygonal cross sections through appropriate adaptation of the device, which can easily be accomplished by the expert.

What is claimed is:

1. A process for producing a catalyst, comprising the steps of:

providing a monolith with a polygonal cross section;

tightly enclosing the monolith with a single part jacket made of metal sheet or plate;

placing a layer of expanded matting between the jacket and the monolith;

bending the jacket with a clamping device into a proper final shape so that edges of the jacket which extend at least essentially in a longitudinal direction of the monolith at least contact each other, the clamping device having at least two profiled pieces that are shaped to conform to a final shape of the jacket and are connected together by a flexible tension element that acts at its circumference on a pressure pad which in turn presses on the jacket, sections of the flexible tension element acting on relatively sharply curved sections of the jacket and the pressure pad acting on and being configured to conform to relatively shallow curved sections of the jacket; and undetachably joining the edges to each other.

2. A process according to claim 1, wherein the edges of the jacket overlap each other.

3. A process according to claim 1, further including preshaping the jacket in a bending device into at least approximately its final form, the preshaped jacket being clamped in the clamping device together with the expanded matting and the monolith so that the jacket has its proper final shape and that its edges are located in a position in which they are to be jointed to each other, and then joining the edge areas to each other.

4. A process according to claim 1, including preshaping the jacket in the bending device into a form which is substantially closed in a circumferential direction.

5. A device for producing a catalyst by providing a monolith with a polygonal cross section, tightly enclosing the monolith with a single part jacket made of metal sheet or plate, and placing a layer of expanded matting between the jacket and the monolith, the device surrounding the jacket made of metal sheet or plate and comprising:

at least two profiled pieces shaped to conform to a final shape of the jacket on a circumference of the device;

a force-actuated device operative to move the profiled pieces toward one another so that the circumference of the device and thus of the jacket is reduced, and so that access to edges of the jacket to be joined together remains between the profiled pieces;

a flexible tension element arranged to connect the profiled pieces together; and at least one pressure pad arranged at a circumference of the tension element so that the tension element presses the pressure pad against the jacket, the flexible tension element having sections arranged to act on relatively sharply curved sections of the jacket, the pressure pad being arranged to act on and being configured to conform to relatively shallow curved sections of the jacket.

6. A device according to claim 5, wherein the flexible tension element has at least two pressure pads arranged on its circumference so as to act on the jacket.

7. A device according to claim 6, wherein the pressure pads are shaped to conform to a final shape of the jacket.

8. A device according to claim 5, wherein the sections of the tension element are chains.

9. A device according to claim 8, wherein the pressure pad is a reinforced link of the chain.

10. A device according to claim 5, wherein the force-actuated device includes tie rods.

11. A device according to claim 10, wherein the force-actuated device exerts forces on the tie rods in a direction approximately tangential to the jacket, the forces on adjacent tie rods proceeding in opposite directions.

12. A device according to claim 10, wherein the force-actuated device includes knuckle joints.

13. A device according to claim 5, wherein the force-actuated device is configured to be actuated and controlled one of mechanically, pneumatically, and hydraulically.

14. A device according to claim 5, and further comprising at least one base for at least one of the tension element and a pressure pad on a side opposite the edges.

15. A device according to claim 14, wherein the base is configured to conform to the shape of at least one of the tension element and the pressure pad.

* * * * *